US006467767B2

(12) United States Patent
Yano

(10) Patent No.: US 6,467,767 B2
(45) Date of Patent: Oct. 22, 2002

(54) SHEET FEEDING APPARATUS AND IMAGE FORMING APPARATUS EQUIPPED WITH IT

(75) Inventor: Takashi Yano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/014,427

(22) Filed: Dec. 14, 2001

(65) Prior Publication Data

US 2002/0074712 A1 Jun. 20, 2002

(30) Foreign Application Priority Data

Dec. 18, 2000 (JP) ..... 2000-383267

(51) Int. Cl.[7] ..... B65H 3/52
(52) U.S. Cl. ..... 271/122; 271/125
(58) Field of Search ..... 271/121, 122, 271/125

(56) References Cited

U.S. PATENT DOCUMENTS 5,996,990 A * 12/1999 Kawashima ..... 271/122
6,260,840 B1 7/2001 Suga et al. ..... 271/10.12
6,349,931 B1 * 2/2002 Kuo et al. ..... 271/121 X
6,378,858 B1 * 4/2002 Suga ..... 271/121 X
6,382,622 B1 * 5/2002 Takada et al. ..... 271/122

* cited by examiner

*Primary Examiner*—David H. Bollinger
(74) *Attorney, Agent, or Firm*—Fitzpatrick, Cella, Harper & Scinto

(57) ABSTRACT

An Object of the present invention is to provide a sheet feeding apparatus that has sheet supporting device, sheet feeding device, separating device, separation force giving device for supplying a separation force to the separating device in a direction reverse to a sheet feeding direction, and separation force switching device for being switched between a connection state for supplying the separation force to the separating device by the separation force giving device and a cut-off state in which the separation force is not supplied to the separating device, wherein said separation force switching device is switched into the cut-off state at a time of a beginning of the feeding and is switched into the connection state when the sheet feeding device has fed the sheets for a predetermined distance from the beginning of the feeding, and a separation force supplied to said separating device in a state such that the separation force switching device is switched into the cut-off state is set to be smaller than a separation force in a state such that the separation force switching device is switched into the connection state.

14 Claims, 9 Drawing Sheets

SHEET FEEDING APPARATUS AND IMAGE FORMING APPARATUS EQUIPPED WITH IT

BACKGROUND OF THE INVENTION

1. Field of the Invention

The present invention relates to a sheet feeding apparatus capable of feeding various sheets and an image forming apparatus equipped with the sheet feeding apparatus.

2. Description of the Related Art

As for a related art sheet feeding apparatus, a sheet feeding apparatus without any pickup roller in a retard separation system is described as an example by the use of FIG. 9. When a not shown solenoid is turned on to start the feeding operation of sheets S stacked and stored on a sheet stacking tray 74, the sheets S are pressed to a sheet feeding roller 51 by an intermediate plate 70. When the pressing has been completed, rotation driving in the clockwise direction in the figure is transmitted to the sheet feeding roller 51 through a sheet feeding roller shaft 52 to pick up a sheet.

Because a separation roller 53 is connected directly with the sheet feeding roller 51 in driving, rotation driving in the direction for pressing back a sheet to the sheet stacking tray 74 (in the clockwise direction in the figure) is transmitted to the separation roller 53 at the same timing as the driving of the sheet feeding roller 51. Because the separation roller 53 is fitted to a separation roller shaft 54 through a torque limiter 61 for generating predetermined torque, the separation roller 53 is constantly giving a fixed separation force (a force operating to press a sheet back to the sheet stacking tray 74) to the sheet during the conveyance operation of the sheet feeding roller 51.

Moreover, the abutting pressure of the separation roller 53 and the value of the torque limiter 61 are set such that the separation roller 53 is dragged by the sheet feeding roller 51 when only one sheet is nipped at a nipping portion between the sheet feeding roller 51 and the separation roller 53, and that the separation roller 53 rotates in the direction of pressing back a sheet piled on and sent with another sheet when two sheets or more are nipped at the nipping portion. When the leading end of the sheet has passed the nipping portion between the sheet feeding roller 51 and the separation roller 53, the pressuring of the sheet by the intermediate plate 70 is released. After that, when the leading end of the sheet reaches evulsion rollers 55*a* and 55*b*, the drive of the sheet driving roller 51 is cut off, and the sheet is pulled out by the evulsion rollers 55*a* and 55*b* to be conveyed.

Because, in such a sheet feeding apparatus, one sheet feeding roller 51 performs both the operation of the picking up of a sheet and the operation of the separation and the conveyance of the sheet, the sheet feeding apparatus has many merits such as the structure thereof is simple and the costs thereof is low and further the apparatus has a high separation performance. On the contrary, because it is difficult to enter a sheet horizontally to a nip tangent of the sheet feeding roller 51 and the separation roller 53 owing to the structure thereof, the sheet feeding apparatus has a weakness such that the apparatus is not suitable for the feeding of special sheets such as a thick sheet, a thin sheet and an envelope.

The reason is described by the use of concrete numerical values in the following. When the outer diameters of the sheet feeding roller 51 and the separation roller 53 are respectively assumed to be 36 mm and 24 mm, a realistic incident angle of a sheet is about 25 degrees at the lowest (the angle changes according to the number of stacked sheets within a range of about 25 to 40 degrees). When the picking up of a sheet is performed at that incident angle, the leading end of the sheet is contacted with the outer peripheral surface of the separation roller 53 at an angle of 40 degrees (when the incident angle is 40 degrees, the contact angle is 65.5 degrees).

The contact pressure of the separation roller 53 to the sheet feeding roller 51 and the returning torque of the torque limiter 61 are designed in a delicate balance for the compatibility of the durability and the document stopping performance of the rollers 51 and 53. Consequently, when a sheet hard to fold such as a thick sheet abuts against the separation roller 53 at such a steep angle, the abutting breaks the dragged movement of the separation roller 53 by the sheet feeding roller 51, and then the separation roller 53 stops rotating before the sheet reaches the nipping portion. Because the conveyance force of the sheet feeding roller 51 is not so strong as to be able to rotate the separation roller 53 compulsorily to push the sheet into the nip, the sheet cannot advance beyond the position. As a result, feed trouble occurs and a jam (sheet clogging) is generated.

Moreover, because the separation roller 53 follows the sheet feeding roller 51 with the lord of the torque limiter 61, the separation roller rotates at a speed slower than the conveyance speed of sheet feeding roller 51 by about 20%. In addition to that, there is a relative speed difference in the sheet conveying direction between the speed of the movement of the leading end of the sheet along the outer periphery of the separation roller 53 and the conveyance speed of the sheet by the sheet feeding roller 51, and the latter tends to send the sheet faster than the former. If the sheet is an ordinal one, the sheet absorbs the speed difference by bending instantaneously, and the sheet can be fed without any problem. However, if the sheet is easy to fold like a thin sheet or a sheet is weak at end portions like an envelope, the leading end of the sheet is downward bent or crashed.

For resolving these problems, two methods have conventionally been used. (1) One of them is to make it hard that the leading end of a sheet hits the outer periphery of the separation roller 53 by adjusting the space gap between a feed guide in the vicinity of the separation roller 53 and the sheet feeding roller 51 to be smaller for correcting the turning direction of the leading end of the sheet by the feed guide to be as near as possible to the nip tangent. (2) The other of them is to prevent the aforesaid problems previously by providing a lever for switching the largeness of the applying pressure of the separation roller 53 to the sheet feeding roller 51, and by a user's selection of a condition according to a sheet to make it easy to feed the sheet.

However, the former method has the problems such that the construction cost thereof becomes high because the method requires the special adjustment, and that a sheet curled downward becomes apt to be caught by the entrance of the feed guide because the feed guide is disposed fairy near to a sheet conveying surface in design. Moreover, the latter method has problems such that, although the method can deal with sheets to a certain extent, the tolerance range of the method is narrow from a point of view of coping with sheet in a wide range, and that the conveyance with a piled sheet and a feed trouble are generated if a user mistook the selection of a feed condition, above all.

SUMMARY OF THE INVENTION

The present invention resolves the aforesaid conventional problems, and aims to provide a sheet feeding apparatus and an image forming apparatus that respectively have a simple structure and can perform stable feeding of various sheets.

According to the present invention, the foregoing and other objects and advantages are attained by a sheet feeding apparatus comprising:

sheet supporting means for supporting sheets;

sheet feeding means for feeding the sheets supported by the sheet supporting means;

separating means for separating the sheets between the sheet feeding means;

separation force giving means for supplying a separation force to the separating means in a direction reverse to a sheet feeding direction; and separation force switching means for being switched between a connection state for supplying the separation force to the separating means by the separation force giving means and a cut-off state in which the separation force is not supplied to the separating means;

wherein the separation force switching means is switched into the cut-off state at the time of the beginning of the feeding and is switched into the connection state when the sheet feeding means has fed the sheets for a predetermined distance from the beginning of the feeding, and a separation force supplied to the separating means in a state such that the separation force switching means is switched into the cut-off state is set to be smaller than a separation force in a state such that the separation force switching means is switched into the connection state.

DETAILED DESCRIPTION OF THE PREFERRED EMBODIMENTS

Next, the attached drawings are referred while an image forming apparatus equipped with a sheet feeding apparatus according to one embodiment of the present invention.

<First Embodiment>

Figure 1:
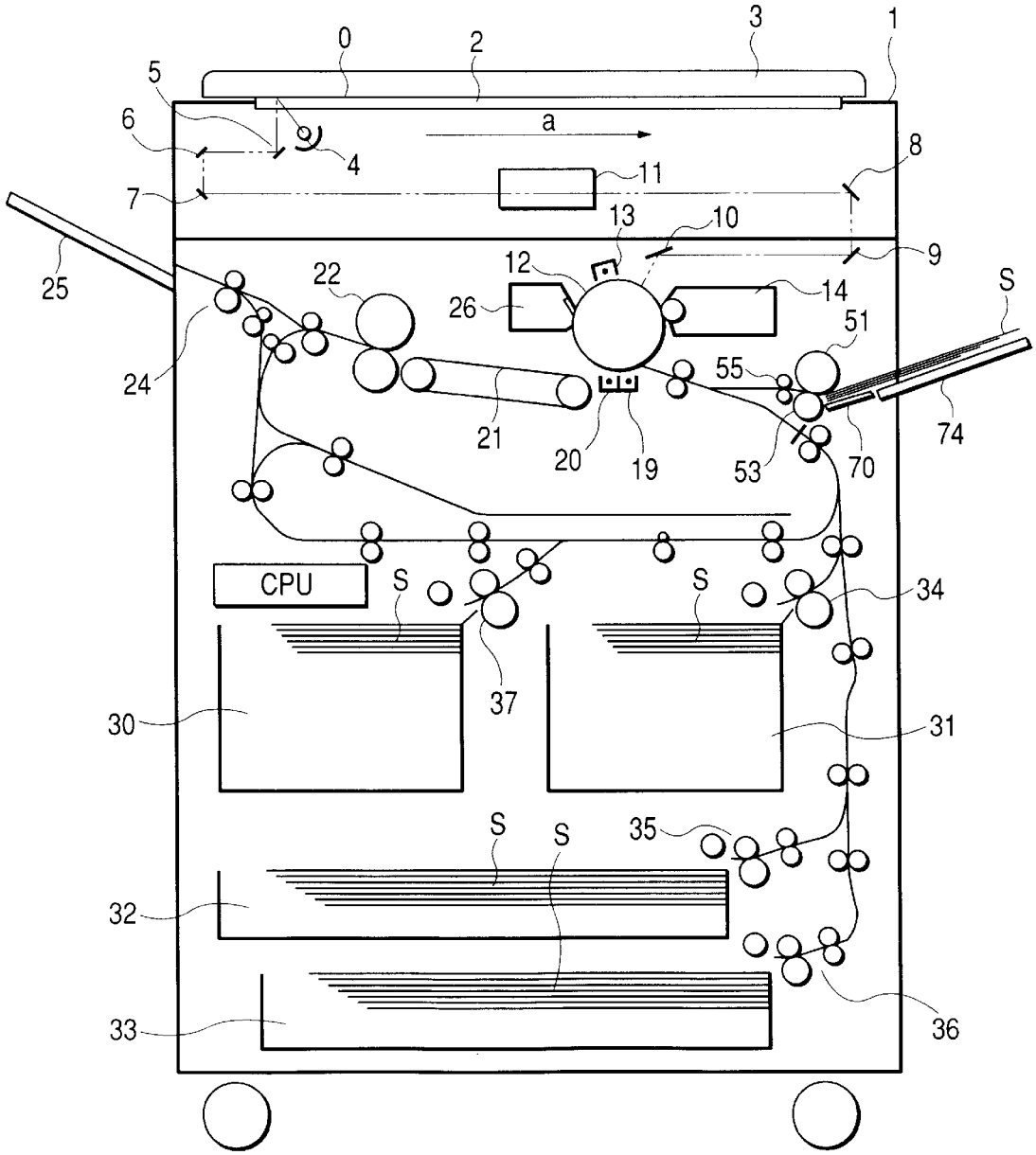
FIG. 1 is an explanatory view of a cross section of a copying machine as an image forming apparatus equipped with a sheet feeding apparatus.

A first embodiment of the present invention is described by the use of FIG. 1 to FIG. 6. FIG. 1 is an explanatory view of a cross section of a copying machine as the image forming apparatus equipped with the sheet feeding apparatus of the invention.

<Whole Structure of Image Forming Apparatus>

In FIG. 1, a reference numeral 1 designates the main body of the copying machine, and at the upper part of the main body 1 an original stand 2 composed of a fixed transparent glass plate is equipped. A reference numeral 3 designates an original pressure plate for pressing and fixing an original O placed on a predetermined position of the original stand 2 with its image bearing surface facing downward. A lamp 4 for illuminating the original O and an optical system composed of reflection mirrors 5, 6, 7, 8, 9 and 10 and an imaging lens 11 for leading the light figure of the illuminated original O to a photosensitive drum 12 are equipped on the lower side of the original stand 2. Incidentally, the lamp 4 and the reflection mirrors 5, 6 and 7 move at a predetermined speed in the direction of an arrow "a" to scan the original O.

A sheet feeding portion is provided with a cassette feeding portion 37, 34, 35 and 36 for feeding stacked sheets on sheet cassettes 30, 31, 32 and 33 built in the main body 1 to an image forming portion, and a feeding portion (hereinafter referred as a multi-feeding portion) composed of a sheet feeding portion 51, 53, 55 and 70 for feeding sheets in various materials and various sizes to the image forming portion from a sheet stacking tray 74.

The image forming means is equipped with the photosensitive drum 12, a charger 13 for performing even charging on the surface of the photosensitive drum 12, a developing device 14 for developing an electrostatic latent image formed by the light figure irradiated from the optical system on the surface of the photosensitive drum 12 to form a toner image to be transferred on a sheet S, a transfer charger 19 for transferring toner image formed on the surface of the photosensitive drum 12 on the sheet S, a separation charger 20 for separating the sheet S on which the toner image has been transferred from the photosensitive drum 12, and a cleaner 26 for removing the toner remained on the photosensitive drum 12 after the transferring of the toner image.

A conveying portion 21 for conveying the sheet S on which the toner image has been transferred and a fixing device 22 for fixing the image on the sheet S conveyed by the conveying portion 21 as a permanent image are provided on the downstream side of the image forming means. Moreover, delivery rollers 24 for delivering the sheet S on which the image is fixed by the fixing device 22 from the main body 1 is provided, and further a delivery tray 25 for receiving the sheet S delivered by the delivery rollers 24 on the outside of the main body 1.

<Sheet Feeding Apparatus>

Figure 2:
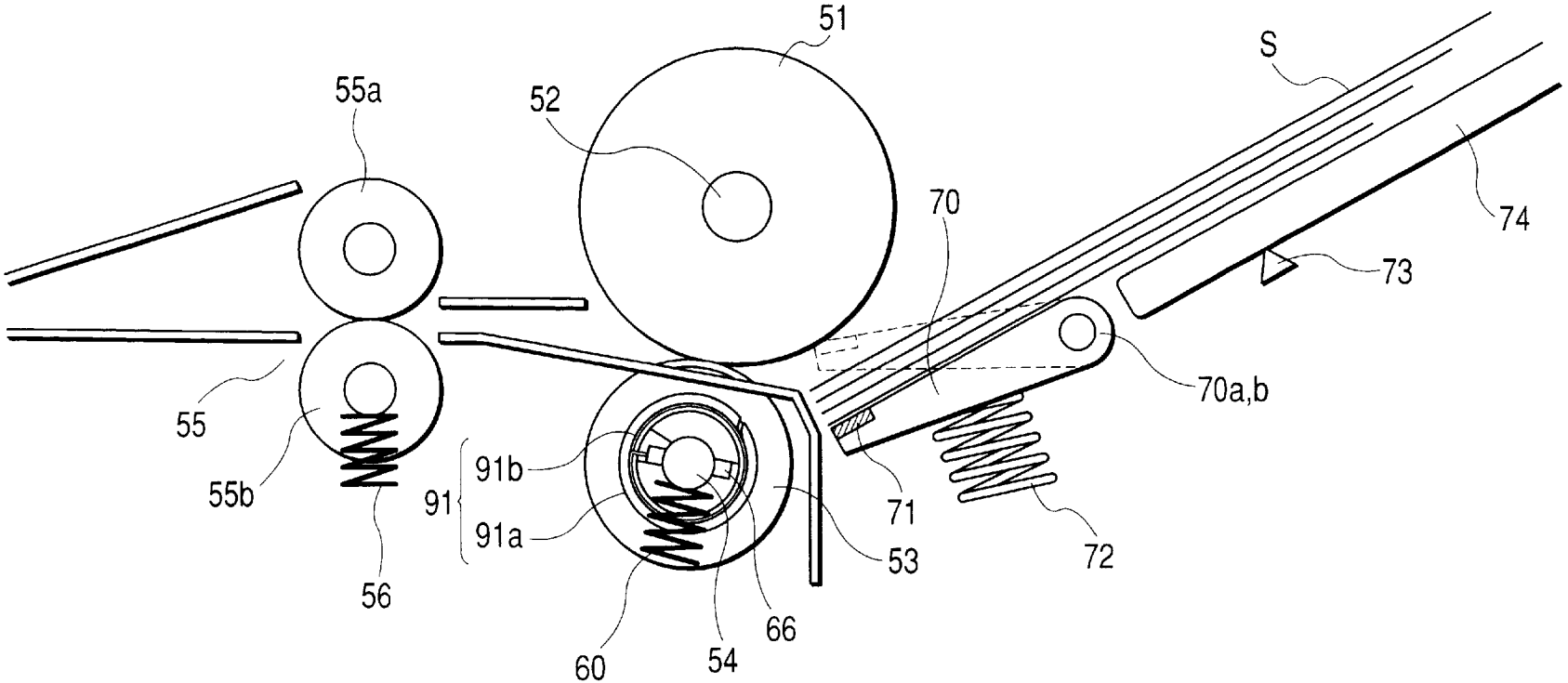
FIG. 2 is an explanatory view of a cross section of the multi-feeding portion of the sheet feeding apparatus.
Figure 3:
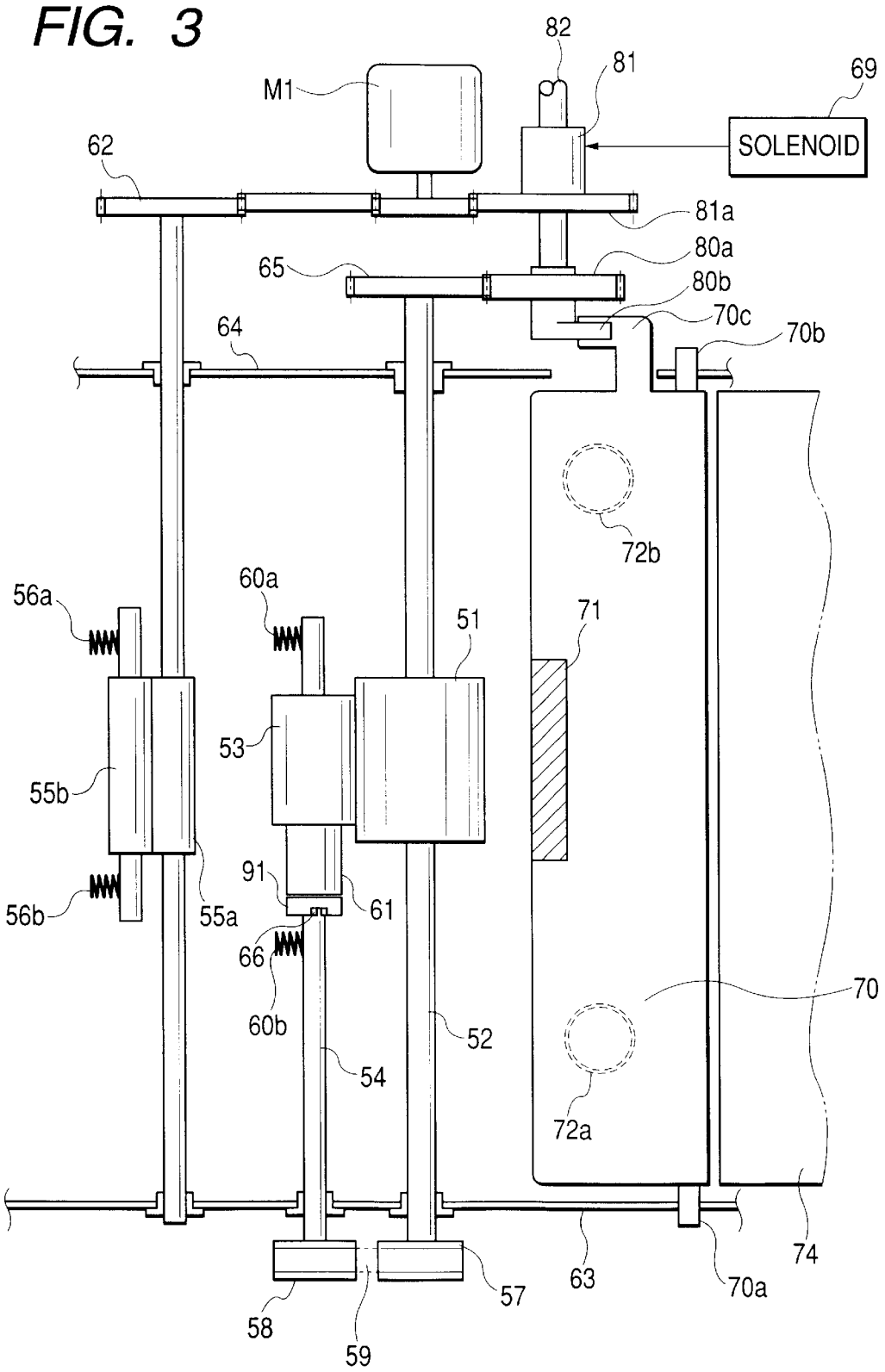
FIG. 3 is an expanded explanatory view of the driving of the multi-feeding portion.

Next, the multi-feeding portion as the sheet feeding apparatus to which the present invention is applied is described. FIG. 2 is an explanatory view of a cross section of the multi-feeding portion, and FIG. 3 is an expanded explanatory view (plan view) of the driving of the multi-feeding portion.

The main body 1 of the copying machine is equipped with the sheet stacking tray 74 for stacking and supporting the sheet S. The sheet stacking tray 74 is equipped with sheet detecting means 73 that is constituted by a photo-interrupter or the like for detecting the existence of the sheet S on the sheet stacking tray 74. The intermediate plate 70 as a sheet pressuring member is swingably set around fulcrums 70*a* and 70*b* to side plates 63 and 64 on the front side and the rear side of the main body 1, and is energized to be pressurized to the sheet feeding roller 51 as the sheet feeding means by pressuring springs 72 (72*a* and 72*b*). The intermediate plate 70 can fittingly switch the state thereof between a pressurizing state to the sheet feeding roller 51 (the state illustrated by a broken line in FIG. 2) and a state of releasing the pressurization to the sheet feeding roller 51 (the state illustrated by a solid line in FIG. 2). Moreover, a felt 71 is set at the tip portion, which abuts against the sheet feeding roller 51, of the intermediate plate 70 in order to prevent the double feeding of the sheet S with a piled sheet and in order to soften an impact at the time of the pressurization of the intermediate plate 70.

The sheet feeding roller 51 is fixed at the sheet feeding roller shaft 52. The sheet feeding roller shaft 52 is axially supported by the front side plate 63 and the rear side plate 64 rotatably. Moreover, a feed driving gear 65 and a pulley 57 are respectively fixed on the rear side part and the front side part of the sheet feeding roller shaft 52. A pulley 58 on the opposite side, which is connected with the sheet feeding roller shaft 52 with a belt 59 to be driven by the sheet feeding roller shaft 52, is fixed at the separation roller shaft 54 which rotates in the same direction as the sheet feeding roller shaft 52 in synchronization with the sheet feeding roller shaft 52.

The separation roller shaft 54 is rotatably provided with the torque limiter 61 as separation force giving means for generating predetermined torque and the separation roller 53 as separating means with a torque controlling mechanism 91, which will be described later, of the present invention between the torque limiter 61 and the separation roller 53. The separation roller 53 is set to be opposed to the sheet feeding roller 51, and the roller 53 is structured to be pressurized to the sheet feeding roller 51 at a predetermined pressure by pressurizing springs 60 (60*a*, 6*b*) with a bearing (not shown). Incidentally, as described above, the rotation of the separation roller 54 is synchronized with the rotation of the sheet feeding roller 51, the separation axis shaft 54 is driven to rotate the separation roller 53 in the opposite direction from the sheet conveying direction of the sheet feeding roller 51. Incidentally, the separation force is the force of the separation roller 53 that pushes a sheet back to the sheet stacking tray 74.

The torque force of the torque limiter 61 and the applying pressure of the pressuring springs 60*a* and 60*b* are set to be within the ranges to meet the following conditions. That is, when only one sheet exists or no sheets exist in a nip between the sheet feeding roller 51 and the separation roller 53, the separation roller 53 follows the feeding roller 51 by frictional force (when the sheet feeding roller is stopping, the separation roller 53 stops); and when two sheets or more exist in the nip, the separation roller 53 is reversed to push the piled sheet back. Incidentally, in this case, the separation force is the force of the separation roller 53 driven through the torque limiter 61 that operates to push the piled sheet back to the sheet stacking tray 74.

A controlling gear 80*a* that is capable of engaging with the feed driving gear 65 and having a cog lacking portion is set at an engaging position opposed to the feed driving gear 65 fixed on the sheet feeding roller shaft 52. Moreover, the controlling gear 80*a* is integrally equipped with an intermediate plate controlling cam 80*b* for controlling the pressurization and the release of the pressure of the intermediate plate 70 to the sheet feeding roller 51. A cam follower 70*c* formed integrally with the intermediate plate 70 on the rear side thereof abuts on the intermediate plate controlling cam 80*b*. Thereby, the operation of pressuring and separation of the intermediate plate 70 to the sheet feeding roller 51 is performed. Moreover, the controlling gear 80*a* is fixed on a driving shaft 82, on which a drive input gear 81*a* built in a spring clutch 81 is equipped.

Then, the spring clutch 81 turns a solenoid 69 for controlling on and off once to make the control gear 80*a* one rotation with the driving shaft 82 integrally. Incidentally, the phase angle between the spring clutch 81 and the cog lacking portion of the controlling gear 80*a* is selected such that the cog lacking portion is placed at a position opposed to the feed driving gear 65 at the waiting time of a feeding operation. Thereby, in a waiting state, although the rotation load of the torque limiter 61 operates to the feed driving gear 65, the sheet feeding roller shaft 52 and the sheet feeding roller 51, they can severally rotate in any direction.

The evulsion roller pair 55 is disposed on the downstream side to the sheet feeding roller 51 in the sheet conveying direction. Because the evulsion roller 55*a* directly connected with a feeding motor M1 in driving through an evulsion driving gear 62, the rotation of the evulsion roller 55*a* synchronizes with the driving of the feeding motor M1. Incidentally, in the present embodiment, a pulse motor is used as the feeding motor M1. Moreover, an evulsion following roller 55*b* is pressurized by springs 56 (56*a* and 56*b*) with a not shown bearing member to the evulsion roller 5*a* to be opposed to it.

When the solenoid 69 is tuned on to start one rotation control, by the operation of the intermediate plate controlling cam 80*b*, the intermediate plate 70 pressurizes a sheet to the sheet feeding roller 51 to make the sheet abut on the sheet feeding roller 51 at first. When the pressurization has completed, a region of the cog lacking portion of the controlling gear 80*a* ends at that timing. The driving of the feed driving gear 65 and the driving of the controlling gear 80*a* are connected to each other, the sheet feeding roller 51 begins the feeding of the sheet.

After the sheet feeding roller 51 has conveyed the sheet by a predetermined conveyance distance, the intermediate plate controlling cam 80*b* operates again to release the pressurizing of the intermediate plate 70 to the sheet feeding roller 51. After that, the sheet feeding roller 51 continues the feeding operation for a distance sufficient for the leading end of the sheet to reach the evulsion roller pair 55. After a little while, when the cog lacking portion of the controlling gear 80*a* has returned at the position opposed to the feed driving gear 65, which is the waiting position, the operation ends.

At this time, because the conveyance of the sheet has been delivered to the evulsion roller pair 55 on the downstream side, the sheet is pulled out from the nipping portion between the sheet feeding roller 51 and the separation roller 53 by the evulsion roller 55*a* to be conveyed to the further downstream side. The aforesaid is the description of a series of feeding operation. The phases and the shapes of the cog lacking portion of the controlling gear 80*a* and the intermediate plate controlling cam 80*b* are adjusted in order to control the feeding of the sheet at such a timing.

(Torque Controlling Mechanism)

Next, the detail of the torque controlling mechanism 91 as separation force switching means provided for realizing the feeding of various sheets with the present sheet feeding apparatus is described.

Figure 4A:
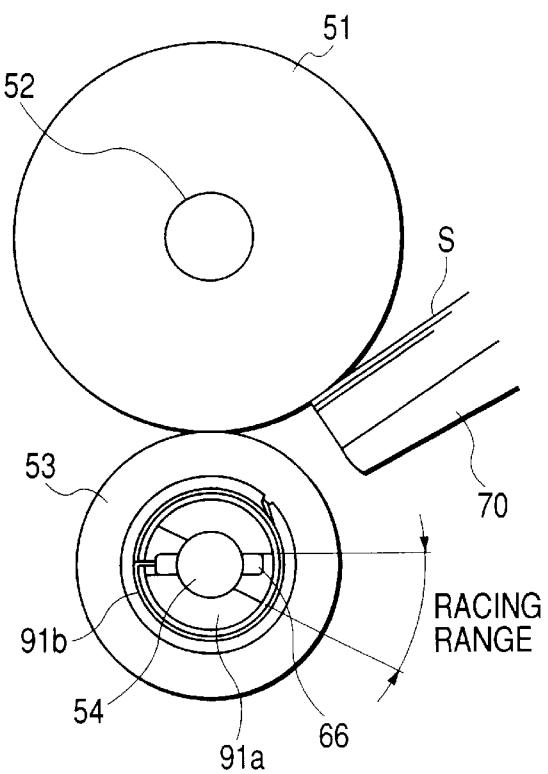
FIGS. 4A, 4B and 4C are explanatory views of the detail and the operation of the torque controlling mechanism of the sheet feeding apparatus.
Figure 4B:
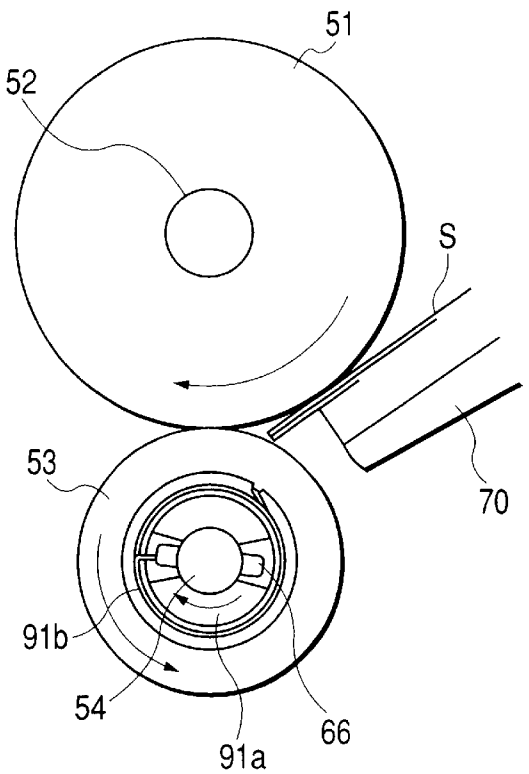
Figure 4C:
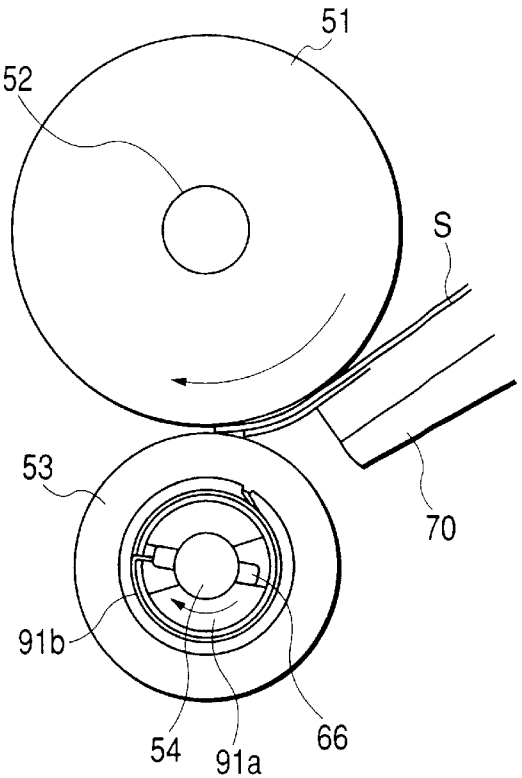

The torque controlling mechanism 91 is composed of an idling angle securing member 91*a* and a torsion coil spring 91*b*. FIGS. 4A to 4C are explanatory views of the details and the operation of the torque controlling mechanism 91. The idling angle securing member 91*a* is attached (fitted) with a clearance of a predetermined angle to a spring pin 66 fixed on the separation roller shaft 54 to be able to rotate freely around the separation roller within the range of the clearance. On the other hand, the torsion coil spring 91*b* is fitted around the idling angle securing member 91*a* as a core with its one end being suspended from the inner diameter of the spring pin 66 of the separation roller shaft 54 and with its the other end being suspended from the idling angle securing member 91*a*.

The torque generated by the torsion coil spring 91*b* operates in the direction such that the separation roller 53 fitted on the end of the torque controlling mechanism 91 pushes a sheet back to the sheet stacking tray 74. By the operation, when driving is not connected to the feed driving gear 65, as shown in FIG. 4A, the idling angle securing member 91*a* is in a state of being energized in the direction of returning the sheet to collide with the spring pin 66. Hereinafter the state is referred to as a "waiting position". Moreover, as shown in FIG. 4C, a state such that the idling angle securing member 91*a* collides with the opposite side of the spring pin 66 is referred to as a "connection position".

When the idling angle securing member 91*a* is between the waiting position and the connection position, the torque controlling mechanism 91 is in a "cut-off state" such that the torque of the torque limiter 61 is not supplied to the separation roller 53. From the connection position, the torque controlling mechanism 91 is in a "connection state" such that the torque of the torque limiter 61 is supplied to the separation roller 53.

Incidentally, the torque to be generate by the torsion coil spring 91*b* is set to be large enough for returning the idling angle securing member 91*a* to the waiting position at the time of disconnection in driving within a range of the clearance of the idling angle securing member 91*a,* and to be smaller than the torque generated by the torque limiter 61.

(Operation of Torque Controlling Mechanism)

Next, the operation of the torque controlling mechanism 91 at the time of feeding. At first, in a feeding waiting state, the idling angle securing member 91*a* is at the waiting position shown in FIG. 4A as described above. When feeding begins and the sheet feeding roller 51 begins to rotate after the pressurization of the intermediate plate 70, the separation roller 53 is also dragged in the sheet conveyance direction by a friction force. However, the separation roller shaft 54 rotates in the sheet returning direction at the same time, and the idler angle securing member 91*a* and the separation roller shaft 54 consequently rotate in the reverse directions to each other. And then, as shown in FIG. 4B, the relative position of the idler angle securing member 91*a* and the separation roller shaft 54 changes. At this time, because the idling torque of the torque limiter 61 is larger than the torque generated by the torsion coil spring 91*b* of the torque controlling mechanism 91, the torque limiter 61 does not operate yet, and only the returning torque generated by the torsion coil spring 91*b* operates on the separation roller 53. Incidentally, in this case, the separation force is a force of the separation roller 53 that operates to pushing a sheet back to the sheet stacking tray 74 only by the returning torque generated by the coil spring 91*b*.

After the rotation has advanced, when the relation position between the idling angle securing member 91*a* and the separation roller shaft 54 reaches the connection position shown in FIG. 4C, driving transmission of the separation shaft 54 and the torque limiter 61 is connected, and the torque limiter 61 begins to generate the predetermined returning torque.

After the one rotation control of the control gear 80*a* has completed, the idling angle securing member 91*b* keeps to maintain the connection position till the evulsion roller 55*a* finishes pulling out the sheet from the nipping portion between the sheet feeding roller 51 and the separation roller 53. After the sheet has been pulled out, because both of the sheet feeding roller 51 and the separation roller 53 become free from a driving load, the idling angle securing member 91*a* makes the separation roller 53 and the sheet feeding roller 51 reverse by the clearance of the predetermined angle by the operation of the torsion coil spring 91*b,* and the idling angle securing member 91*a* returns to the waiting position.

Incidentally, according to the driving mechanism, the sheet feeding roller 51 and the separation roller 53 are substantially connected in driving at two points of the driving transmission portion 57, 58 and 59 and the abutting portion of both the rollers 51 and 53 in the directions reverse to each other. Consequently, if one more driving clearance besides the idling angle securing member 91*a* is not formed, the driving trains interfere each other after a sheet has passed through the nipping, and thereby the idling angle securing member 91*a* cannot return to the waiting position. In the present embodiment, the problem is resolved by the fitting of the pulley 57 on the sheet feeding roller shaft side to the sheet feeding roller shaft 52 with a clearance of an amount corresponding to the idling angle of the idling angle securing member 91*a*. When the largeness of the returning torque supplied to the separation roller 53 in the series of feeding operations is shown as a graph, it is shown like FIG. 5.

Now, it is described from a mechanical viewpoint how the mechanism contributes to the stable feeding of various sheets. Because, when a strict mechanical analysis is performed, many parameters, such as the hardness of a sheet, which is difficult to make definite influence to each other, and the formula for the calculation becomes very complicated. The description is given to a model assuming the feeding of a ultra thick sheet.

(Feeding of Thick Sheet)

Hereupon, sheets are regarded as complete rigid bodies, and it is supposed that their portions in the vicinity of the abutting ends on the separation roller 53 do not bend at all. Moreover, for the reflection of actual phenomena, a state such that the pressurizing mechanism of the separation roller 53 shunts by the abutting of the leading end of a sheet to the separation roller 53 and then the separation roller 53 is separated from the sheet feeding roller 51 is supposed (namely, it is supposed that all of the pressuring force of the separation roller 53 is received by the sheet).

Figure 6:
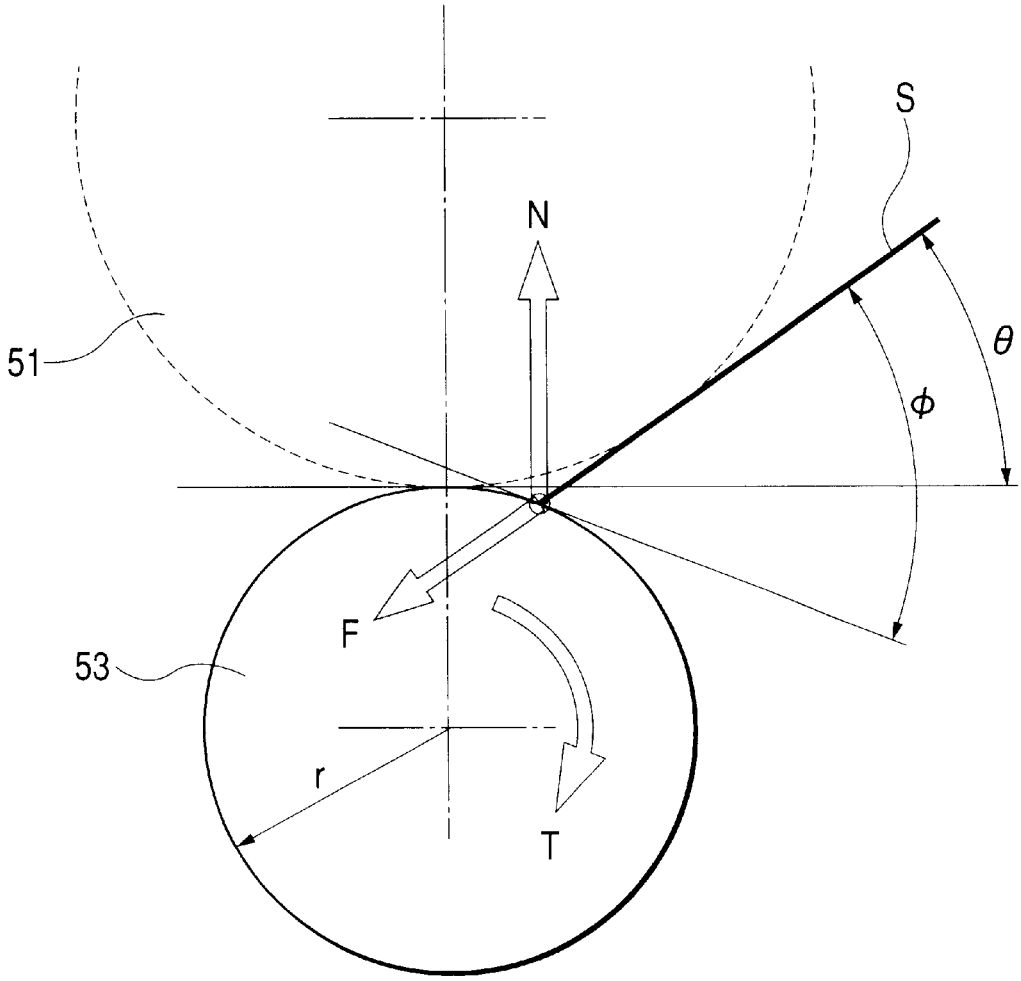
FIG. 6 is a schematic explanatory view of a mechanical model of the sheet feeding of the sheet feeding apparatus.

The outline of the mechanical model is shown in FIG. 6. The conditional expression of a conveyance force F capable of pushing a sheet into the nipping portion between the sheet feeding roller 51 and the separation roller 53 without causing any feed trouble in the relation of the mechanical balance in the sheet entering direction becomes as follows:

$$F > N \times \cos(90-\theta) + (T/r) \times \cos\phi$$

Where θ is an incident angle of the sheet to the nip line between the sheet feeding roller 51 and the separation 53; ϕ is an angle formed by the tangential line of the separation roller 53 and the sheet at an abutting point of the outer periphery of the separation roller 53 and the leading end of the sheet; N is the pressurizing force of the separation roller 53 to the sheet feeding roller 51; T is a torque force generated by the torque limiter 61; r is a radius of the separation roller 53; and F is a conveyance force of the sheet given from the sheet feeding roller 51 (a substantial conveyance force obtained by subtracting the friction resistance between the lower sheet).

A calculation is performed by applying realistic values of the sheet feeding apparatus. When the following values are substituted into the conditional expression: the torque T of the torque limiter 61 is 33.8307 mJ (345 gf·cm); the pressurizing force N of the separation roller 53 is 2.9421 N (300 gf); the radius r of the separation roller 53 is 12 mm; and the incident angle θ of the sheet is 30 degrees (the angle ϕ is determined to be 48.3 degrees according to the aforesaid setting of the values), the conditional expression becomes as follows: F>3.24906 N (331.3 gf).

However, because the coefficient of friction of the rubber material of the sheet feeding roller 51 to the sheet is 1.4, and the coefficient of friction between sheets is about 0.5, and the sheet pressurizing force of the intermediate plate 70 is set to be about 2.15754 N (220 gf) in consideration of the endurance performance to the sending of a sheet with a piled sheet, only about 1.9614 N (200 gf) of the conveyance force F can be estimated. Consequently, a sheet feeding apparatus in which the torque controlling mechanism 91 is not incorporated could not convey the sheet further from the sheet feeding roller 51 to generate a feed trouble because the sheet feeding roller slips.

On the contrary, in a sheet feeding apparatus equipped with the torque controlling mechanism 91 like the present embodiment, only returning torque T' smaller than the torque T generated by the torque limiter 61 operates to the separation roller 53 while the idling angle securing member 91 moves from the waiting position thereof to the connection position thereof. Even if a realistic system is considered, because the torque T' to be generated by the torsion coil spring 91*b* can be suppressed to be about 9.806 mJ (100 gf·cm), when the value is substituted into the aforesaid conditional expression, a result: F>1.91629 N (195.4 gf) can be obtained, which indicates the possibility of feeding. It is of course that, because the conditional expression used hereupon is based on a model in case of assuming the sheet to be a complete rigid body, the aforesaid condition is stricter than an actual condition. The conveyance force F in the present embodiment has a sufficient margin in case of an ordinal sheet conveyance.

(Feeding of Thin Sheet)

Although the description has been performed on the assumption of the picking up of a thick sheet till now, similar description can be given to the feeding of an envelope, a thin sheet and the like.

At first, in case of an envelope, because the envelope is made by folding a sheet, the apparent elasticity is hard like a thick sheet. However, the strength of its end portions being folds is small. Consequently, when an end portion thereof abuts against the separation roller 53 at the time of feeding, the rotation of the separation roller 53 in the conveyance direction easily stops, or the efficiency of the rotation of the separation roller 53 easily lowers. Besides, the end portion of the envelope easily bent downward by the influence of the stopping or the lowering of the rotation of the separation roller 53.

Moreover, because the separation roller 53 is generally dragged by the sheet feeding roller 51 in a state of receiving the returning torque of the torque limiter 61, the rotation speed of the separation roller 53 always has a loss of about 20% of the conveyance speed of the sheet feeding roller 51. Thereby, a relative speed difference is generated between the speed of the sheet feeding roller 51 to send out a sheet and the speed of the leading end of the sheet to move along the outer periphery of the separation roller 53. In case of an ordinary sheet, the folding of the leading end of the sheet does not occur by the speed difference in such a degree. However, when a sheet being very easy to fold such as a thin sheet is conveyed, the sheet is easily folded downward.

The aforesaid phenomena are all problems brought about the largeness of the returning torque of the separation roller 53. Because the returning torque at the initial stage of feeding is the small returning torque generated by the torque controlling mechanism 91 without the operation of the torque limiter 61 by the equipment of the torque controlling mechanism 91 like the present embodiment, almost all of the aforesaid loss is not generated in the dragging of the separation roller 53 by the sheet feeding roller 51. Consequently, there is no speed difference between the speed of the sheet feeding roller 51 to send a sheet and the speed of the leading end of the sheet to move along the outer periphery of the separation roller 53, and even if the sheet is easy to fold, the folding thereof downward does not occur.

(Setting of Idling Distance)

Next, the setting method of the idling distance of the torque controlling mechanism 91 is described. As having been described so far, a returning torque smaller than the torque of the torque limiter 61 operates to the separation roller 53 during the idling of the torque controlling mechanism 91. As an influence thereof, the separation performance of the separation roller 53 is lowered during the idling. Lest the lowering of the separation performance should influence the feeding performance of the sheet feeding apparatus, the setting of the idling angle of the torque controlling mechanism is performed as follows.

In a sheet feeding apparatus in the retard separation system, the level of the endurance performance to the sending of a sheet with a piled sheet sharply changes dependently on whether a bundle of sheets pushes through the nipping portion between the sheet feeding roller 51 and the separation roller 53 or not. Accordingly, the timing is needed to be adjusted such that the predetermined torque of the torque limiter 61 operates to the separation roller 53 before the leading ends of the sheets reach the nipping portion.

To put it concretely, the clearance of the idling angle securing member 91 is set such that the sheet conveyance distance L (or the dragging distance of the separation roller 53) by the sheet feeding roller 51 is equal to or longer than the distance L1 from the front end portion of the sheet stacking tray 74 to the position where a sheet abuts against the separation roller 53, and is equal to or shorter than the distance L2 form the leading end portion of the sheet stacking tray 74 to the nipping portion between the sheet feeding roller 51 and the separation roller 53. By the suitable setting in such a way, the stable feeding of various sheets can be realized without deteriorating the endurance performance to the sending of a sheet with a piled sheet.

Incidentally, although the torque controlling mechanism 91 and the torque limiter 61 are constituted as separate bodies, it is needless to say that the function of the torque controlling mechanism 91 may be built into the torque limiter 61.

<Second Embodiment>

The present invention is not limited to use the torque controlling mechanism 91 in the form described with regard to the first embodiment. Next, a method in which returning torque is not operated at all at the time of initial low torque rotations is described as a second embodiment by the use of FIG. 7 and FIGS. 8A to 8C. Incidentally, the descriptions of the same components as those of the first embodiment are omitted, and components having the same functions are designated by the same reference numerals in the drawings.

Figure 7:
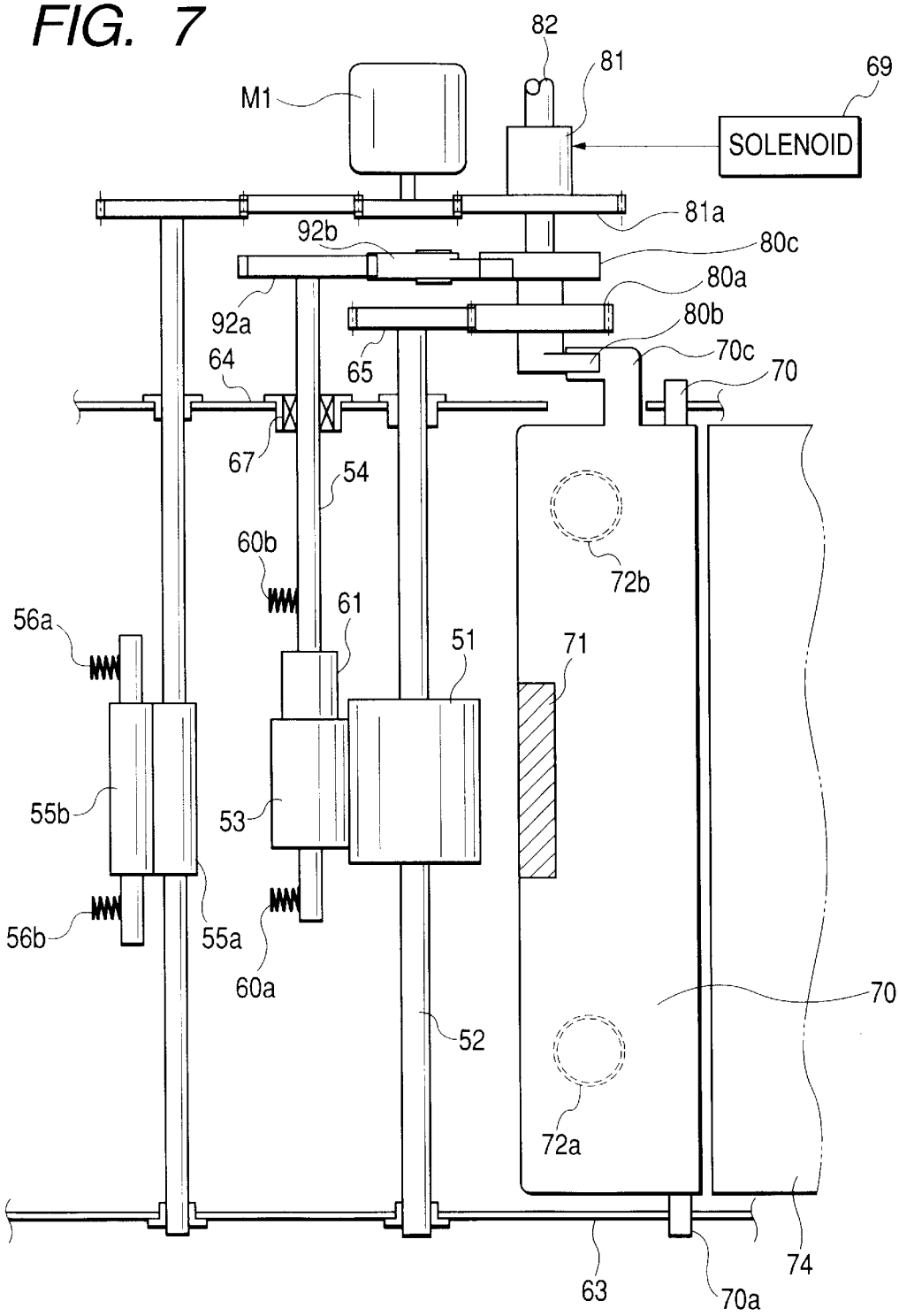
FIG. 7 is an expanded explanatory view of the driving of a sheet feeding apparatus according to a second embodiment.
Figure 8A:
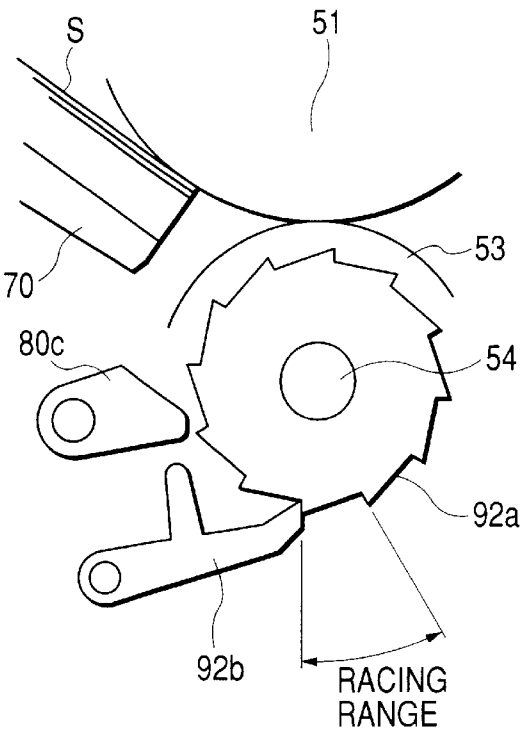
FIGS. 8A, 8B and 8C are explanatory views of the operation of a torque controlling mechanism of the sheet feeding apparatus when it is viewed from the back side of the apparatus.
Figure 8B:
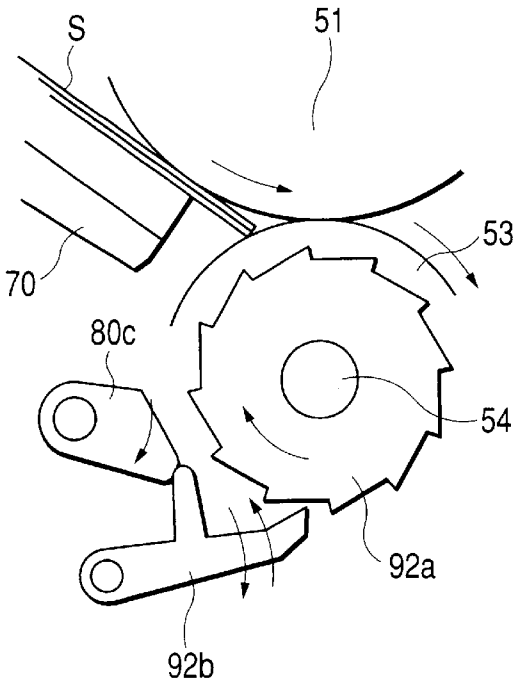
Figure 8C:
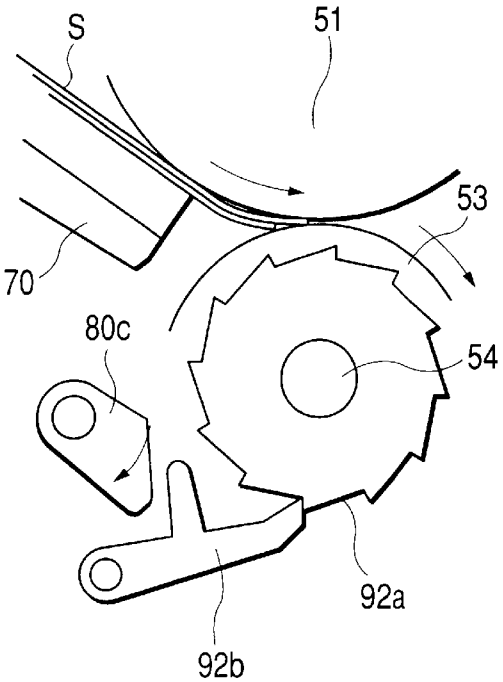
Figure 9:
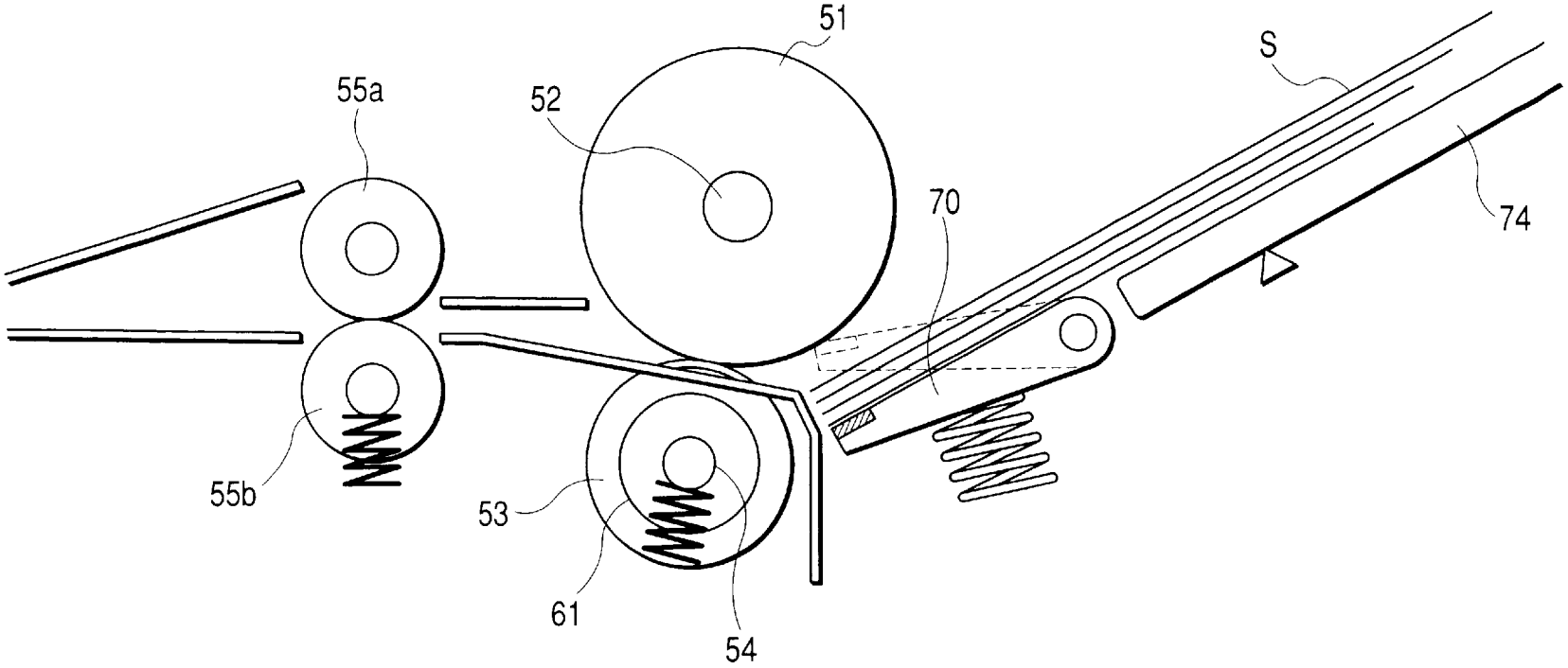
FIG. 9 is a sheet feeding apparatus according to related art.

FIG. 7 is an expanded explanatory view of the driving of a sheet feeding apparatus according to the second embodiment, and FIGS. 8A to 8C are explanatory views of the operation of a torque controlling mechanism of the sheet feeding apparatus when it is viewed from the back side of the apparatus. The basic structure of the sheet feeding apparatus is a retard separation system feeding mechanism without any pickup roller similarly to that of the first embodiment. However, the apparatus of the present embodiment is a type in which returning driving is not input into the separation roller shaft 54.

Because the operation control of the sheet feeding roller 51 and the intermediate plate 70 used the same mechanisms as those of the first embodiment, the description thereof is not repeated hereupon. A ratchet gear 92*a* is fixed on one end of the separation roller shaft 54. A ratchet pawl 92*b*, the movement of which is regulated by a separation controlling cam 80*c* formed integrally with the controlling gear 80*a*, is engaged with the ratchet gear 92*a* as a stopper (see FIG. 8A).

Moreover, a one way clutch 67 is fixed on the separation roller shaft 54, and then the rotation of the separation roller shaft 54 in the sheet returning direction is regulated. When the feeding of a sheet begins, the intermediate plate 70 makes the sheet abut against the sheet feeding roller 51 with a pressure. Then, before driving is transmitted from the feed driving gear 65 from the controlling gear 80*a*, the separation controlling cam 80*c* pulls out the ratchet pawl 92*b* form the ratchet gear 92*a*. Thereby, as shown in FIG. 8B, the separation roller shaft 54 enters into a state in which the separation roller shaft 54 can freely rotate in the sheet conveyance direction. When rotation driving is input into the feed driving gear 65 and the sheet feeding roller 51 begins to rotate, the separation controlling cam 80*c* immediately returns the ratchet pawl 92*b* to a position where the ratchet pawl 92*b* can engage with the ratchet gear 92*a*.

As described above, before the separation roller 53 has been dragged by the sheet feeding roller 51 for a predetermined amount of rotation and the ratchet gear 92*a* and the ratchet pawl 92*b* have engaged with each other, the torque limiter 61 does not operate at all, and the separation roller 53 follows the sheet feeding roller 51 without any load. However, as shown in FIG. 8C, after the engagement of the ratchet gear 92*a* and the ratchet pawl 92*b* the rotation of the separation roller shaft 54 stops. Consequently, the torque limiter 61 generates the predetermined returning torque.

Incidentally, the idling amount of the separation roller 53 is set to be the same as that of the first embodiment. Thereby, the second embodiment can also realize the stable feeding of a wide range of sheets.

The endurance performance to the sending of a sheet with a piled sheet is slightly inferior to that of the first embodiment by the degree such that returning driving is not input into the separation roller 53, but the second embodiment can realize a very high performance as to the stable feeding of a wide range of sheets because no returning torque operates to the separation roller at all during a period before the rotation of the separation roller shaft 54 stops.

<Other Embodiments>

Incidentally, in both the aforesaid first and the second embodiments, the sheet feeding apparatuses without any pickup roller are exemplified to be described, but the present invention is not limited to such structures. Even in a sheet feeding apparatus in the type performing the pickup of a sheet by the ascending and the descending of the pickup member such as a pickup roller, a pickup belt and the like, the present invention can obtain the same effects.

Moreover, although, in the aforesaid embodiments, examples using the sheet feeding roller 51 and the separation roller 53, both being a roller, as the sheet feeding means and the separating means, respectively, have been exemplified, it is needless to limit them to be in a roller shape. Means capable of giving a feeding force or a returning force may be employed as the sheet feeding means and the separating means, respectively. For example, means in a shape of belt such as a feeding belt and a separation belt may be employed.

Furthermore, although, in the aforesaid embodiments, examples of the copying machines as image forming apparatuses to which the sheet feeding apparatus of the present invention is applied have been described, the present invention is not limited to such application. For example, the present invention can be applied to an image reading apparatus by being equipped with image reading means on the downstream side in the sheet conveying direction of a sheet feeding apparatus of the invention.

Although the invention has been described in its preferred form with a certain degree of particularity, obviously many changes and variations are possible therein. It is therefore to be understood that the present invention may be practiced than as specifically described herein without departing from scope and the sprit thereof.

What is claimed is:

1. A sheet feeding apparatus comprising:

sheet supporting means for supporting sheets;

sheet feeding means for feeding the sheets supported by said sheet supporting means;

separating means for separating the sheets between said sheet feeding means;

separation force giving means for supplying a separation force to said separating means in a direction reverse to a sheet feeding direction; and separation force switching means for being switched between a connection state for supplying the separation force to said separating means by said separation force giving means and a cut-off state in which the separation force is not supplied to said separating means;

wherein said separation force switching means is switched into the cut-off state at a time of a beginning of the feeding and is switched into the connection state when said sheet feeding means has fed the sheets for a predetermined distance from the beginning of the feeding, and a separation force supplied to said separating means in a state such that said separation force switching means is switched into the cut-off state is set to be smaller than a separation force in a state such that said separation force switching means is switched into the connection state.

2. A sheet feeding apparatus according to claim 1, wherein said separating means includes a separation roller, and said separation force switching means forms a clearance for making the separation roller rotatable freely within a constant rotation angle between said separation force giving means and the separation roller.

3. A sheet feeding apparatus according to claim 2, wherein said separation force giving means includes an elastic member for biasing the separation roller in a rotation direction reverse to the sheet feeding direction within a range of the clearance, and wherein said separation force giving means supplies a separation force smaller than a separation force in the connection sate during a period from a beginning of the feeding to a time when the cut-off state is switched to the connection state with the elastic member.

4. A sheet feeding apparatus according to claim 3, wherein said separation force giving means transmits driving from a driving source to the separation roller through a torque limiter for generating predetermined returning torque when said separation force switching means is switched into the connection state.

5. A sheet feeding apparatus according to claim 4, wherein the separation roller and the torque limiter are attached to a separation roller shaft in such a way that the predetermined torque generated by the torque limiter rotates the separation roller, and wherein an idling angle securing member for forming the clearance between the separation roller and the separation roller shaft is disposed between the torque limiter and the separation roller shaft.

6. A sheet feeding apparatus according to claim 2, wherein the separation roller is attached to a separation roller shaft to which driving is not transmitted through a torque limiter for generating predetermined torque, and wherein said separation force switching means forms the clearance between the torque limiter and the separation roller shaft such that it is possible to idle the separation roller shaft in the sheet feeding direction by a predetermined angle, and said separation force switching means stops rotation of the separation roller shaft after idling by the predetermined angle.

7. A sheet feeding apparatus according to claim 6, wherein said separation force switching means includes a ratchet gear provided on the separation roller shaft and a ratchet pawl engaging with the ratchet gear, wherein the clearance is set to be a range from a breakaway of the ratchet pawl from a cog of the ratchet gear to engagement of the ratchet pawl to a next cog of the ratchet gear, and wherein the separation roller shaft is stopped when the ratchet pawl engages with the ratchet gear.

8. A sheet feeding apparatus according to claim 1, wherein a distance L for which said sheet feeding means conveys the sheets during a period from a beginning of feeding the sheets to supply of said separation force giving means of a predetermined separation force to said separating means by said separation force switching means is satisfied a following relation:

$$L1<L<L2$$

where L1 is a distance from a tip end position of the stacked sheets to a position at which the fed sheets abut against said separating means at first, and L2 is a distance from the tip end position of the stacked sheets to a position at which said sheet feeding means and said separation means abut against each other.

9. A sheet feeding apparatus according to claim 1, wherein said sheet feeding means includes a sheet feeding roller driven to rotate, and a sheet pressurizing member capable of switching pressuring abutting and separating of the sheets to the sheet feeding roller.

10. A sheet feeding apparatus according to claim 1, wherein said sheet feeding means includes a pickup member that can switch pressuring abutting and separating to a surface of the stacked sheets, and a sheet feeding roller that is disposed on downstream side of said pickup member and is driven to rotate.

11. A sheet feeding apparatus comprising:

a sheet stacking tray for supporting sheets;

a sheet feeding roller for feeding the sheets supported by said sheet stacking tray;

a separation roller, provided to be in pressure contact with said sheet feeding roller, for separating the sheets between said sheet feeding roller by being supplied with a separation force in a direction reverse to a sheet feeding direction by a driving source;

a separation roller shaft which is rotated by being transmitted a driving of said driving source;

an idling angle securing member disposed between said separation roller and said separation roller shaft, for setting a clearance for permitting a relative rotation within a constant angle range between said separation roller and said separation roller shaft; and a spring biasing said separation roller in a rotation direction reverse to the sheet feeding direction within the constant angle range;

wherein a separation force to be supplied to said separation roller by said spring at a time of idling of said separation roller by said idling angle securing member is set to be smaller than a separation force of said separation roller by a driving force from the driving source.

12. A sheet feeding apparatus according to claim 11, wherein a torque limiter for transmitting a driving force of predetermined torque to said separation roller is disposed between said separation roller shaft and said separation roller.

13. An image forming apparatus comprising:

sheet supporting means for supporting sheets;

sheet feeding means for feeding the sheets supported by said sheet supporting means;

separating means for separating the sheets between said sheet feeding means;

separation force giving means for supplying a separation force to said separating means in a direction reverse to a sheet feeding direction;

separation force switching means for being switched between a connection state for supplying the separation force to said separating means by said separation force giving means and a cut-off state in which the separation force is not supplied to said separating means; and image forming means for forming an image on a sheet separated and fed by said sheet feeding means and said separating means;

wherein said separation force switching means is switched into the cut-off state at a time of a beginning of the feeding and is switched into the connection state when said sheet feeding means has fed the sheets for a predetermined distance from the beginning of the feeding, and a separation force supplied to said separating means in a state such that said separation force switching means is switched into the cut-off state is set to be smaller than a separation force in a state such that said separation force switching means is switched into the connection state.

14. An image forming apparatus comprising:

a sheet stacking tray for supporting sheets;

a sheet feeding roller for feeding the sheets supported by said sheet stacking tray;

a separation roller provided to be in pressure contact with said sheet feeding roller, for separating the sheets between said sheet feeding roller by being fed with a separation force in a direction reverse to a sheet feeding direction by a driving source;

a separation roller shaft which is rotated by being transmitted a driving of said driving source;

an idling angle securing member disposed between said separation roller and said separation roller shaft, for setting a clearance for permitting a relative rotation within a constant angle range between said separation roller and said separation roller shaft;

a spring biasing said separation roller in a rotation direction reverse to the sheet feeding direction within the constant angle range; and image forming means for forming an image on a sheet separated and fed by said sheet feeding roller and said separation roller;

wherein a separation force to be supplied to said separation roller by said spring at a time of idling of said separation roller by said idling angle securing member is set to be smaller than a separation force of said separation roller by a driving force from the driving source.

* * * * *

UNITED STATES PATENT AND TRADEMARK OFFICE

CERTIFICATE OF CORRECTION

PATENT NO. : 6,467,767 B2
DATED : October 22, 2002
INVENTOR(S) : Takashi Yano

Figure 5:
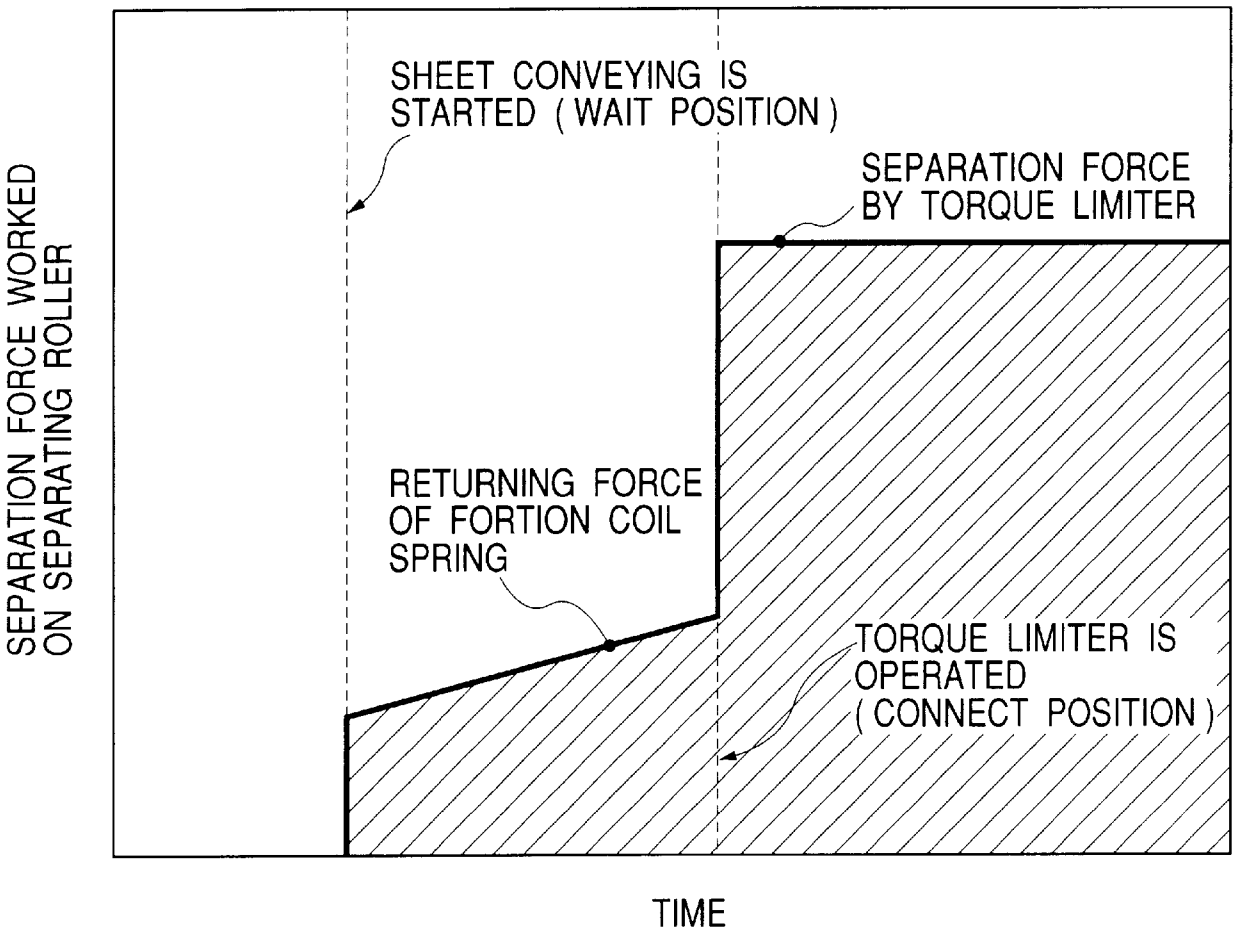
FIG. 5 is a graph showing the largeness of the returning torque supplied to a separating roller of the sheet feeding apparatus.

It is certified that error appears in the above-identified patent and that said Letters Patent is hereby corrected as shown below:

Drawings,
Sheet 5, Figure 5, “FORTION” should read -- TORSION --.

Column 1,
Line 54, “is” should read -- are --.

Column 2,
Line 40, “that” should read -- for --.
Line 41, “hits” should read -- for --.
Line 55, “by” should read -- at --.
Line 56, “fairy” should read -- fairly --.

Column 4,
Lines 13 and 17, “refection” should read -- reflecting --.
Line 23, “referred” should read -- referred to --.
Line 24, “in” should read -- of --.
Line 38, “remained” should read -- remaining --.

Column 5,
Line 31, “6b) with” should read -- 60b) with --.

Column 6,
Line 9, “to” should be deleted.
Line 22, “5a to” should read -- 55a to --.
Line 23, “tuned” should read -- turned --.
Line 41, “at” should read -- to --.

Column 7,
Line 2, “the” (2nd occurrence) should be deleted.
Line 25, “generate” should read -- generated --.
Line 52, “pushing” should read -- push --.
Line 63, “keeps to” should be deleted.

Column 8,
Line 14, “interfere” should read -- interfere with --.
Line 28, “to” (2nd occurrence) should read -- on --.
Line 62, “sheet).” should read -- sheets). --.

UNITED STATES PATENT AND TRADEMARK OFFICE

CERTIFICATE OF CORRECTION

PATENT NO. : 6,467,767 B2
DATED : October 22, 2002
INVENTOR(S) : Takashi Yano

It is certified that error appears in the above-identified patent and that said Letters Patent is hereby corrected as shown below:

Column 9,
Line 48, “lowers.” should read -- decreases. --.
Line 49, “bent” should read -- is bent --.

Column 10,
Line 25, “to” should read -- of --.
Line 31, “to” should be deleted.
Line 41, “form” should read -- from --.

Column 11,
Line 19, “form” should read -- from --.
Line 33, “pawl 92b” should read -- pawl 92b, --.
Line 46, “to” should be deleted.

Column 12,
Line 11, “than” should read -- more than --.
Line 51, “sate” should read -- state --.

Column 13,
Line 24, “is satisfied” should read -- satisfies --.
Line 37, “switching pressuring” should read -- switching, pressuring, --.

Signed and Sealed this

Third Day of June, 2003

JAMES E. ROGAN
*Director of the United States Patent and Trademark Office*